United States Patent [19]

Levin

[11] Patent Number: 4,630,819

[45] Date of Patent: Dec. 23, 1986

[54] COLLAPSIBLE PLAYGROUND DEVICE

[76] Inventor: Eliezar Levin, c/o Avi Nakash, 498 7th Ave., New York, N.Y. 11803

[21] Appl. No.: 649,187

[22] Filed: Sep. 10, 1984

[51] Int. Cl.[4] ..... A63B 17/00

[52] U.S. Cl. ..... 272/113; 182/49; 182/118; 182/152; 272/56.5 R

[58] Field of Search ..... 272/113, 112, 56.5 R, 272/109; 182/115, 116, 117, 118, 49, 152

[56] References Cited

U.S. PATENT DOCUMENTS

| | | | |
|---|---|---|---|
| 212,050 | 2/1879 | Phillips | 182/118 X |
| 316,643 | 4/1885 | Niehaus | 182/118 X |
| 579,437 | 3/1897 | Knisell | 182/118 X |
| 737,080 | 3/1903 | Conner | 182/117 X |
| 1,484,480 | 2/1924 | Donaggio | 182/116 |
| 2,012,592 | 1/1935 | Skiba | 182/118 X |
| 2,312,148 | 2/1943 | Cederquist | 182/124 X |
| 2,858,055 | 10/1958 | De Long et al. | 182/116 |
| 3,501,140 | 3/1970 | Eichorn | 272/112 X |
| 3,516,659 | 6/1970 | Kleid | 272/113 X |
| 3,547,435 | 12/1970 | Scott | 272/112 X |
| 3,814,416 | 6/1974 | Munger et al. | 272/113 X |
| 3,969,871 | 7/1976 | Ewers | 272/113 X |
| 3,971,561 | 7/1976 | Wenzel | 272/56.5 R |
| 4,023,647 | 5/1977 | Confer | 182/118 X |
| 4,097,043 | 6/1978 | Rudy | 272/113 |
| 4,159,113 | 6/1979 | Callecod | 272/56.5 R X |
| 4,278,250 | 7/1981 | Baynes et al. | 272/113 |
| 4,365,799 | 12/1982 | O'Brian et al. | 272/56.5 R |

FOREIGN PATENT DOCUMENTS

| | | | |
|---|---|---|---|
| 2218560 | 10/1973 | Fed. Rep. of Germany | 272/56.5 R |
| 2706140 | 8/1978 | Fed. Rep. of Germany | 182/117 |

*Primary Examiner*—Richard J. Apley
*Assistant Examiner*—Robert W. Bahr
*Attorney, Agent, or Firm*—Benjamin J. Barish

[57] ABSTRACT

A collapsible playground device comprises a plurality of ladder sections pivotably mounted to each other at their ends, and attaching members for releasably securing the ladder sections at any desired angular position with respect to each other when in use, and to be folded on top of each other into compact form for storage or handling when not in use. The device further includes a supporting base plate at the free ends of the end ladder sections for supporting the device on a horizontal surface, and a slide section attachable at one end to one of the rungs of one of the ladder sections for supporting the slide section at an incline during use.

5 Claims, 11 Drawing Figures

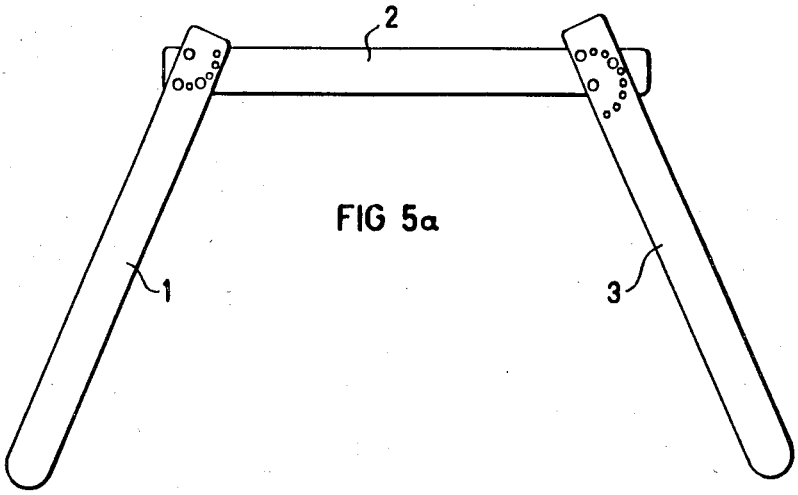
FIG 5a
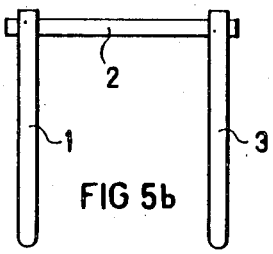
FIG 5b
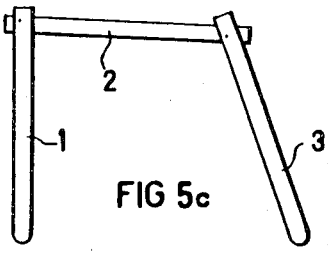
FIG 5c
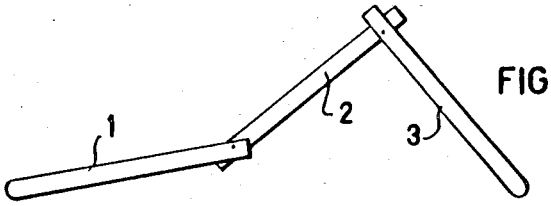
FIG 5d
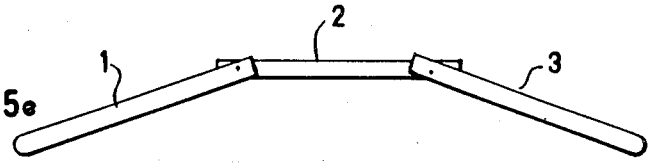
FIG 5e
FIG 5f
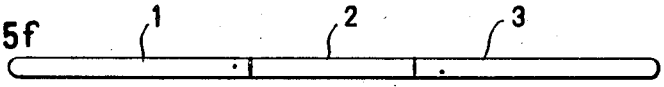

COLLAPSIBLE PLAYGROUND DEVICE

FIELD OF THE INVENTION

The invention relates to a collapsible playground device, particularly useful as a juvenile gymnastic for fitness and fun device that is light, sturdy and strong, portable, adjustable, versatile.

To be used outdoors or indoors, it can be folded to a minimal size for convenient storage in a closet, an indoor corner or a shed.

SUMMARY OF THE INVENTION

According to the present invention, there is provided a collapsible playground device, comprising at least three ladder sections each having a pair of parallel frame members and a plurality of rungs fixed to and extending transversely across the frame members in parallel spaced relationship to each other along the length of the frame members; first attaching means for releasably attaching one end of the first ladder section to one end of the second ladder section with the two ladder sections at a desired angular position with respect to each other; and second attaching means for releasably attaching the opposite end of the second ladder section to one end of the third ladder section with the latter two ladder sections at a desired angular position with respect to each other.

In the preferred embodiment of the invention described below, each of the attaching means comprises a pivot pin passing through the ends of the respective ladder sections permitting them to be pivoted to the desired angular position with respect to each other when in use, and to be folded on top of each other into compact form for storage or handling when not in use. Each of the attaching means further comprises a locking pin passing through the respective ends of the ladder sections and locking them in the desired angular position with respect to each other.

More particularly, in the described embodiment, the frame members of each of the ladder sections are flat. At least one of the flat frame members at each pivotable end of the ladder sections is formed with a first opening for receiving the pivot pin, and a plurality of further openings in a circular array around the first opening for selectively receiving the locking pin.

Also in the described preferred embodiment, the opposite ends of the first and third ladder sections, not attached to the second ladder section, are each provided with a base plate for supporting the three ladder sections on a horizontal surface.

Preferably, the first and second ladder sections include rigid rungs, and the third ladder section includes rope rungs.

The described preferred embodiment further includes a slide section attachable at one end to one of the rungs of one of the ladder sections for supporting the slide section at an incline.

This device can be set up in minutes to different adjustable positions which will meet the exercise needs of the users. It is versatile because it can be used as, but not imited to the following:

(a) Frame for a swing or baby bouncer;
(b) Playpen utilizing wall of the room;
(c) Frame for tent;
(d) Stand for drawing board or black board (either side or both);

(e) Base for an exhibition or work table.

The device is intended for use by toddlers as young as 6 months and children up to 8 years old.

Setting up the device to desired position and adjustment of its structural elements for height and inclination is done by an adult using an appropriate wrench.

It is through the variety of exercises afforded by the device's changeable and adjustable positions, that a closer relationship of cooperation is established between a child and parents by a shared experience.

As a child becomes proficient in his/her exercises, the device can be adjusted for exercises of a more advanced nature or a higher versatile because it can be used for many other uses, in addition to a collapsible playground, including the following:

The variety of positions offered by the device, encourage exercising as fun and promote the physical as well as psychomotor development in the child, coordination of body movements, balancing, testing of strength and self assurance. Some positions offered by the device can be used for remedial exercises where specific movements of body/body parts are encouraged to overcome physical/emotional difficulties.

DESCRIPTION OF DRAWING

FIGS. 5*a*–5*f* show in a schematic form some of the various adjustable positions to which the device can be set up.

DETAILED DESCRIPTION

Figure 1:
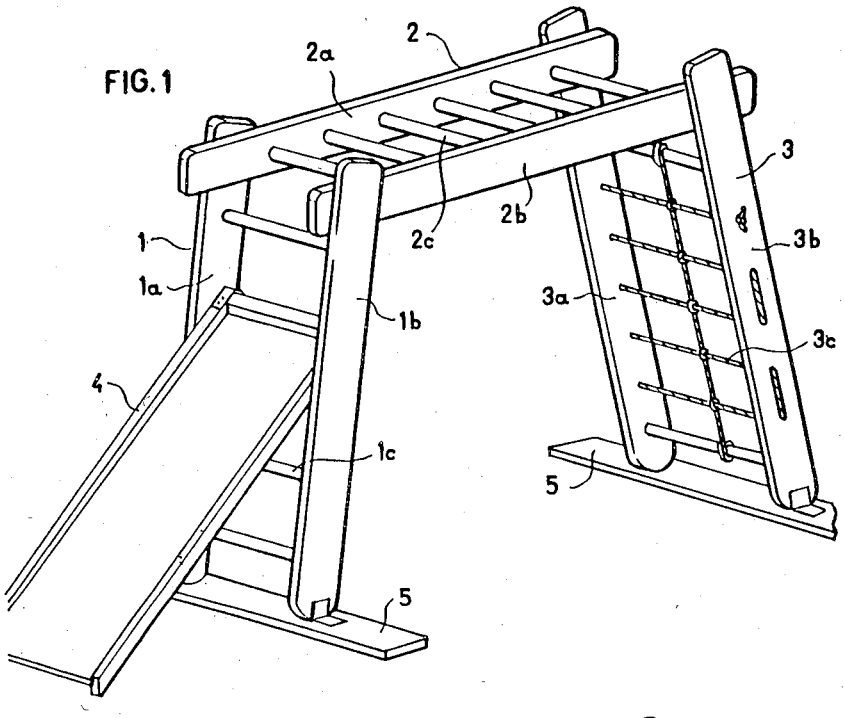
FIG. 1 is an isometric view of the device, set up to one of its various exercise positions.
Figure 2:
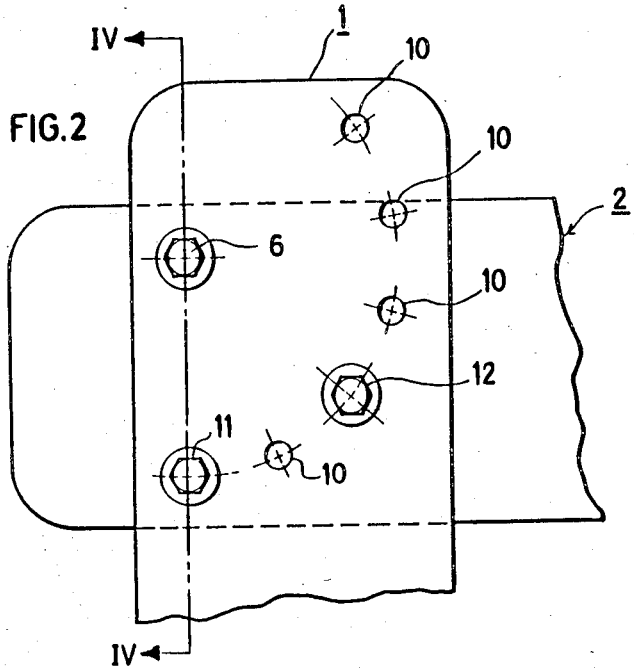
FIG. 2 shows an elevation view of one of four typical pivot joint assemblies between ladder sections 1, 2 and 3.
Figure 3:
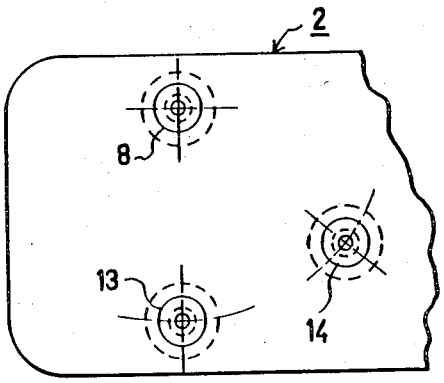
FIG. 3 is a fragmentary view of the end of ladder section 2 of FIG. 2.
Figure 4:
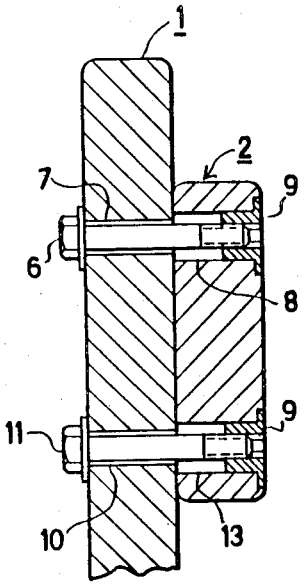
FIG. 4 is a cross section through a pivot pin and locking pin of FIG. 2.

The device as shown in FIG. 1 is comprised of four integral structural members; two ladder sections 1, 2 with solid rungs, one ladder section 3 with rope rungs and one slide section 4 which is attached with hooks to a rung of ladder section 1 and is detachable complementary member of the device. As can be seen from FIG. 1, each of the ladder sections 1, 2, 3 includes a pair of parallel, flat frame members 1*a*, 1*b*; 2*a*, 2*b*; and 3*a*, 3*b*, respectively; and a plurality of rungs 1*c*, 2*c*, 3*c* fixed to and extending transversely across the frame members of the respective ladder section in parallel spaced relationship to each other along the length of the frame members. The device further includes first attaching means for releasably attaching one end of ladder section 1 to one end of ladder section 2, with the two ladder sections at a desired angular position with respect to each other; and second attaching means for releasably attaching the opposite end of ladder section 2 to one end of ladder section 3 with the latter two ladder sections at a desired angular position with respect to each other. A typical pivot joint assembly is shown in FIG. 2 and represents the one between ladder sections 1 and 2. FIG. 3 is a disassembled view of section 2 from FIG. 2. FIG. 4 is a cross section through FIG. 2. To understand the construction and operation of pivot joint assembly, reference to FIGS. 2, 3, 4 is required.

Thus, as shown in FIGS. 2–4, each of the flat frame members at the pivotable end of ladder section 1 is formed with a hole 7 for receiving a pivot pin 6, and with a further series of holes 10 equal distance from each other and arranged in a circular array around, and at a fixed radius from, hole 7. The latter holes are adapted to receive locking pins 11 and 12. Each of the frame member at the corresponding end of ladder section 2 is formed with three holes, as shown at 8, 13 and 14 in FIG. 3. Thus, ladder section 1 may be releasably attached to ladder section 2 at any angular position with respect thereto by: passing pivot pin 6 through the central opening 7 in ladder section 1 and through opening 8 in ladder section 2; pivoting the two ladder sections to the desired angular position; and then passing locking pins 11 and 12 through two of the holes 10 in ladder section 1, and through holes 13 and 14 in ladder section 2. The ends of the pins 6, 11 and 12 are threaded into headed nuts 9 (FIG. 4) recessed in ladder section 2.

Ladder section 3 is similarly mounted at any desired angular position with respect to the opposite end of ladder section 2.

The device can be set up within minutes to any of the different exercise positions some of which are shown in FIG. 5.

To achieve these positions, pivot screw 6 is loosened in the frame members of the respective ladder sections, and screws 11 and 12 are removed. This procedure is repeated on the other frame members of the respective ladder sections so that one end of the respective ladder section can pivot around the end of ladder section 2.

It can be seen that when ladder section 1 moves about its pivot, two holes 10 will line up in succession with holes 13, 14 in ladder section 2, thus forming different angles between ladder sections 1 and 2 at one end.

An appropriate angle between ladder sections 1 and 2 is chosen and two holes 10 are lined up with holes 13, 14; lock pins 11, 12 are inserted and secured to the frame member of ladder section 2 and lock pin 11, 12 are tightened to form a rigid joint. This procedure is repeated on the second frame member of ladder section 2.

To change the angle between ladder sections 2 and 3 for a desired position, the procedure outlined above is to be followed.

The free ends of the outer ladder sections 1 and 3 include base bars 5 of large surface area pivotably mounted to, and extended across, the parallel frame members of the respective section for supporting the playground device on the ground.

Figure 6:
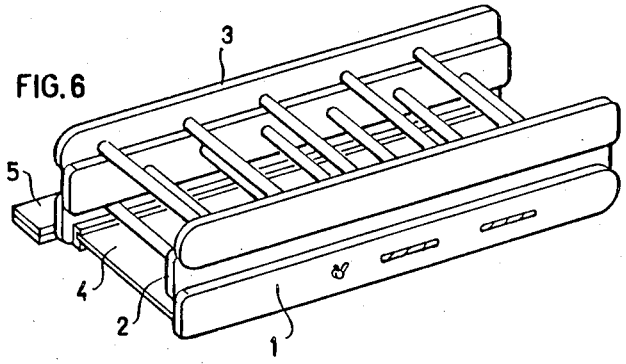
FIG. 6 is an isometric view of the device in its folded position ready for convenient storage.

Pivot joint between base bars 5 and ladder sections 1, 3 provide for self alignment of base bars when position changes are made to the devices's structural members. When storage of the device is desired, the slide 4 is detached from ladder section 1, pin 11, 12 are removed (4 places), pivot pin 6 loosened (4 places) and ladder sections 1 and 3 are folded about ladder section 2 to form a compact arrangement of minimum size as shown in FIG. 6 (removal of base bars is optional).

FIGS. 5*a*–5*f* illustrate some of the many adjustable positions in which the device can be set up. Thus, FIG. 5*a* illustrates a conventional arrangement similar to that of FIG. 1; FIG. 5*b* illustrates an arrangement wherein the two end ladder sections 1 and 3 are parallel to each other and perpendicular to the ground; FIG. 5*c* illustrates an arrangement wherein ladder section 1 is perpendicular to the ground, ladder section 2 is parallel to the ground, the ladder section 3 is at an incline to the ground; FIG. 5*d* illustrates an arrangement wherein ladder section 1 is at a small incline to the ground, ladder section 2 is at a larger incline to the ground, and ladder section 3 is inclined in the opposite direction and thereby stably supports ladder sections 1 and 2; FIG. 5*e* illustrates an arrangement wherein the two end ladder sections 1 and 3 are oppositely inclined and the middle ladder section 2 is parallel to the ground; and FIG. 5*f* illustrates an arrangement wherein all the ladder sections 1, 2 and 3 are aligned in a straight line to rest on the ground. FIG. 6 illustrates the device folded into a compact form when not in use, conveninent for storage or transportation.

I claim:

1. A playground device, comprising:

a plurality of ladder sections including at least a first, a second and a third ladder section;

each of said ladder sections having a pair of parallel frame members and a plurality of rungs fixed to and extending transversely across said frame members in parallel spaced relationship to each other along the length of said frame members;

first attaching means for releasably attaching one end of said first ladder section directly to one end of said second ladder section with the two ladder sections at a desired angular position with respect to each other;

second attaching mens for releasably attaching the opposite end of said second ladder section directly to one end of said third ladder section with the latter two ladder sections at a desired angular position with respect to each other;

the free ends of each of said first and second ladder sections including a base bar of large surface area pivotably mounted to, and extending across, the parallel frame members of the respective section for supporting the playground device on the ground;

the pair of frame members of each ladder section being bars formed with flat, parallel, outer surfaces at each end where coupled to another ladder section;

each of the flat surfaces of one pair of frame members at each coupled end being formed with a first opening, and with a plurality of further openings arranged in a circular array;

each of the flat surfaces of the other pair of frame members at each coupled end being formed with a first opening alignable with said first opening of said one pair of frame members, and with another opening alignable with a selected one of said circular array of openings in said one pair of frame members;

said first and second attaching means each comprising a pivot pin passing through each of said aligned first openings in the coupled ends of the frame members, and a locking pin passing through said selected one of the circular array of openings in said one pair of frame members and said aligned other opening in said other pair of frame members for locking the two ladder sections at each coupled end at a selected angular position with respect to each other.

2. The device according to claim 1, wherein said first and second ladder sections include rigid rungs, and said third ladder section includes rope rungs.

3. The device according to claim 1, further including a slide section attachable at one end to one of the rungs of one of the ladder sections and restable at the other end on the ground for supporting said slide section at an incline.

4. A playground device, comprising:

a plurality of ladder sections including at least a first, a second and a third ladder section;

each of said ladder sections having a pair of parallel frame members and a plurality of rungs fixed to and extending transversely across said frame members in parallel spaced relationship to each other along the length of said frame members;

first attaching means for releasably attaching one end of said first ladder section directly to one end of said second ladder section with the two ladder sections at a desired angular position with respect to each other;

second attaching means for releasably attaching the opposite end of said second ladder section directly to one end of said third ladder section with the latter two ladder sections at a desired angular position with respect to each other;

the free ends of each of said first and second ladder sections including a base bar of large surface area pivotably mounted to, and extending across, the parallel frame members of the respective section for supporting the playground device on the ground;

the pair of frame members of each ladder section being bars formed with flat, parallel, outer surfaces at each end where coupled to another ladder section;

each of the flat surfaces of one pair of frame members at each coupled end being formed with a first opening, and with a plurality of further openings arranged in a circular array;

each of the flat surfaces of the other pair of frame members at each coupled end being formed with a first opening alignable with said first opening of said one pair of frame members, and with another opening alignable with a selected one of said circular array of openings in said one pair of frame members;

said first and second attaching means each comprising a pivot pin passing through each of said aligned first openings in the coupled ends of the frame members, and a locking pin passing through said selected one of the circular array of openings in said one pair of frame members and said aligned other opening in said other pair of frame members for locking the two ladder sections at each coupled end at a selected angular position with respect to each other;

and a slide section attachable at one end to one of the rungs of one of the ladder sections and restable at the other end on the ground for supporting said slide section at an incline.

5. The device according to claim 4, wherein said first and second ladder sections include rigid rungs, and said third ladder section includes rope rungs.

* * * * *